US006619986B1

(12) United States Patent
Yeh

(10) Patent No.: US 6,619,986 B1
(45) Date of Patent: Sep. 16, 2003

(54) ELECTRICAL CONNECTOR WITH METAL SHIELD

(75) Inventor: JOel Y. Yeh, San Gabrie, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/126,847

(22) Filed: Apr. 19, 2002

(51) Int. Cl.[7] ..... H01R 13/648
(52) U.S. Cl. ..... 439/607; 439/571; 439/79
(58) Field of Search ..... 439/607–610, 439/79, 571

(56) References Cited

U.S. PATENT DOCUMENTS 6,093,057 A * 7/2000 Lok ..... 439/607
6,203,353 B1 * 3/2001 Huang et al. ..... 439/352
6,241,556 B1 * 6/2001 Chih ..... 439/607
6,267,623 B1 * 7/2001 Hisamatsu ..... 439/607
6,319,063 B1 * 11/2001 Huang ..... 439/610

* cited by examiner

*Primary Examiner*—Hien Vu
(74) *Attorney, Agent, or Firm*—Wei Te Chung

(57) ABSTRACT

An electrical connector (7) has a metal shield (1) and an insulative housing (2) with a plurality of terminals (3) insert molded therewith. The shield has a top wall (10), two side walls (11, 12) and a bottom wall (13). Each of the top wall and the bottom wall has a flange (101, 131) with a pair of semi-circular bumps (108, 133) at a front edge thereof, and a pair of slots (102, 132) extending through corresponding semi-circular bumps. The top wall has a pair of retentive tabs (105, 106). The housing has a body portion (20) and a pair of side portions (21, 22). Each side portion has a notch (211, 221) defined therein, a standoff (212, 222) and a protrusion (213, 223) with an aperture (214, 224) defined therebetween. The retentive tabs engage with corresponding notches through the apertures of the housing.

11 Claims, 4 Drawing Sheets

ELECTRICAL CONNECTOR WITH METAL SHIELD

FIELD OF THE INVENTION

The present invention generally relates to an electrical connector, and more particularly to an electrical connector having a metal shield and a housing thereof reliably engaged with each other.

BACKGROUND OF THE INVENTION

It is well known that a cellular phone is provided with an electrical connector for enabling the cellular phone to connect with an auxiliary electrical device. JP Publication Patent Nos. 11-111389 and 9-259981 disclose such electrical connectors used in this field. A catalog of Hirose Company also shows electrical connectors for enabling cellular phones to connect with electrical devices.

TW Patent application No. 83216732 discloses an electrical connector with a shield, a housing and a plurality of terminals. Neither the shield or the housing has positioning tabs for securely engaging a printed circuit board (PCB), so that a reliable connection between the soldering portions of the terminals and the PCB cannot be formed.

U.S. Pat. No. 6,077,118 discloses an electrical connector having a housing with a plurality of terminals assembled therein. A metal shield attaches to the housing for providing electromagnetic interference shielding. The metal shield is stamped from sheet metal of certain thickness and includes a pair of engaging tabs abutting against the housing. The metal shield further includes two end portions forming a joint. A thickness of the overlapped end portions is substantially equal to the thickness of the sheet metal. However, a problem of this configuration is that the metal shield is unlikely secured to the housing thereby resulting a poor electrical connection between. the terminals and a PCB.

FIG. 4 discloses a conventional electrical connector 5. The electrical connector 5 has an insulative housing 50, a plurality of terminals 52 insert molded with the housing 50, and a metal shield 53 enclosing the housing 50. Each terminal 52 has a contacting portion (not shown) and a soldering portion 521 soldered to a PCB (not shown). The shield 53 has a plurality of flanges 532 at front edges thereof and a pair of retentive tabs 531 extending downwardly to abut against a front face of the housing 50. The retentive tabs 531 resist a pull-out force acting on the housing 50 when a mating connector (not shown) is withdrawn from the connector 5.

However, the retentive tabs 531 of the conventional electrical connector 5 distort easily when a push force is exerted on the housing, so that the retentive tabs 531 cannot effectively resist a push-in force acting on the housing 50 during insertion of the mating connector into the connector 5. As a result, the engagement between the housing 50 and the shield 53 can be easily broken thereby transmitting the acting force directly to the connection formed between the terminals 52 and the PCB. In a worst case, a malfunction will be experienced resulted from electrical disconnections. Furthermore, since no additional securing structure is provided on the shield 53, a proper and reliable engagement between the mating connector and the connector 5 cannot be ensured when the mating connector is inserted therein and withdrawn therefrom.

Hence, an improved connector is needed to eliminate the above mentioned defects of the conventional connector.

BRIEF SUMMARY OF THE INVENTION

A main object of the present invention is to provide an electrical connector having a shield and a housing thereof reliably engaged with each other.

A second object of the present invention is to provide an electrical connector with additional securing means for ensuring a proper and reliable engagement with a mating connector.

A third object of the present invention is to provide an electrical connector, ensuring a reliable connection between terminals thereof and a printed circuit board (PCB).

An electrical connector of the present invention has a metal shield, a dielectric housing and a plurality of terminals. The shield has a top wall, a first and a second side walls, and a bottom wall formed by bending the side walls. A winding slit is defined in the bottom wall by two opposed end portions of the shield. A first and a second retentive tabs downwardly extend from rear side edges of the top wall. A first flange With top semi-circular bumps and a fourth flange with bottom semi-circular bumps are formed respectively at front edges of the top and bottom walls. A pair of slots are defined in each of the top wall and the bottom wall and extend through corresponding semi-circular bumps. A first and a second cutouts are defined in the top wall adjacent to the retentive tabs. A first locating tab and a second locating tab extend downwardly from the respective side walls. The housing has a mating end with a plurality of passageways defined therein and a body portion with two side portions formed on two lateral sides of the body portion. Each side portion has a standoff and a protrusion with an aperture defined therebetween. A notch is defined in each of the side portions.

In assembly, the plurality of terminals are insert molded in the housing with the contact portions thereof received in the passageways. The housing is enclosed by the shield. The winding slit strengthens the integrity of the shield. The slots of the metal shield receive corresponding ribs of a mating connector when the mating connector is inserted into the connector. The retentive tabs of the shield engage with the notches of the side portions of the housing through the corresponding apertures, the standoffs of the housing project into the cutouts of the metal shield, and the protrusions abut against a rear edge of the top wall of the shield, so that relative movement between the housing and the shield is prevented. The first and second locating tabs are adapted to position the electrical connector on a PCB. The bottom sides of the soldering portions of the terminals are coplanar with the bottom wall of the shield, whereby the soldering portion can be soldered to appropriate circuit traces on the PCB.

Other objects, advantages and novel features of the invention will become more apparent from the following detailed description of a preferred embodiment when taken in conjunction with the accompanying drawings.

DETAILED DESCRIPTION OF THE INVENTION

Figure 1:
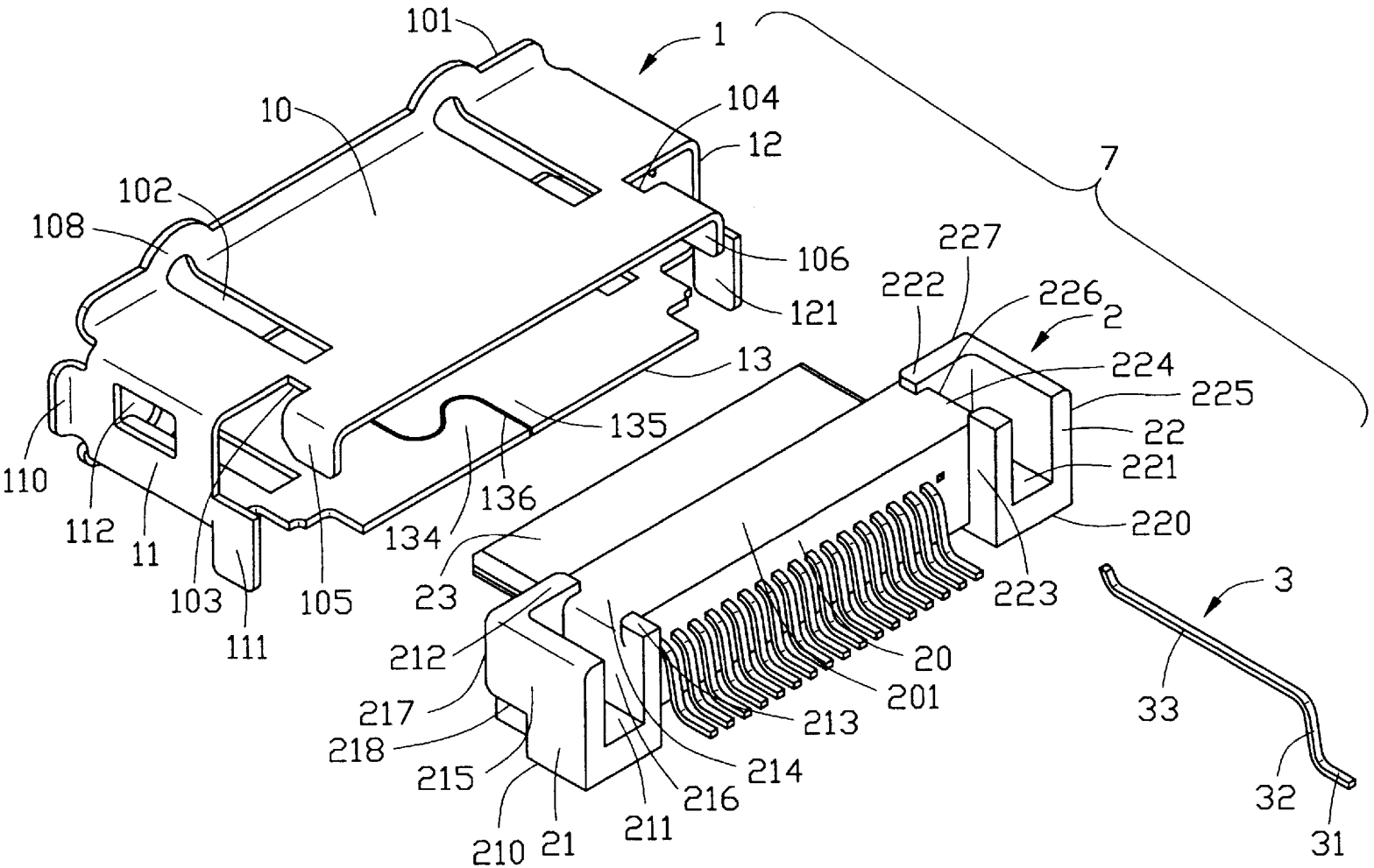
FIG. 1 is a perspective, exploded view of an electrical connector in accordance with the present invention.
Figure 2:
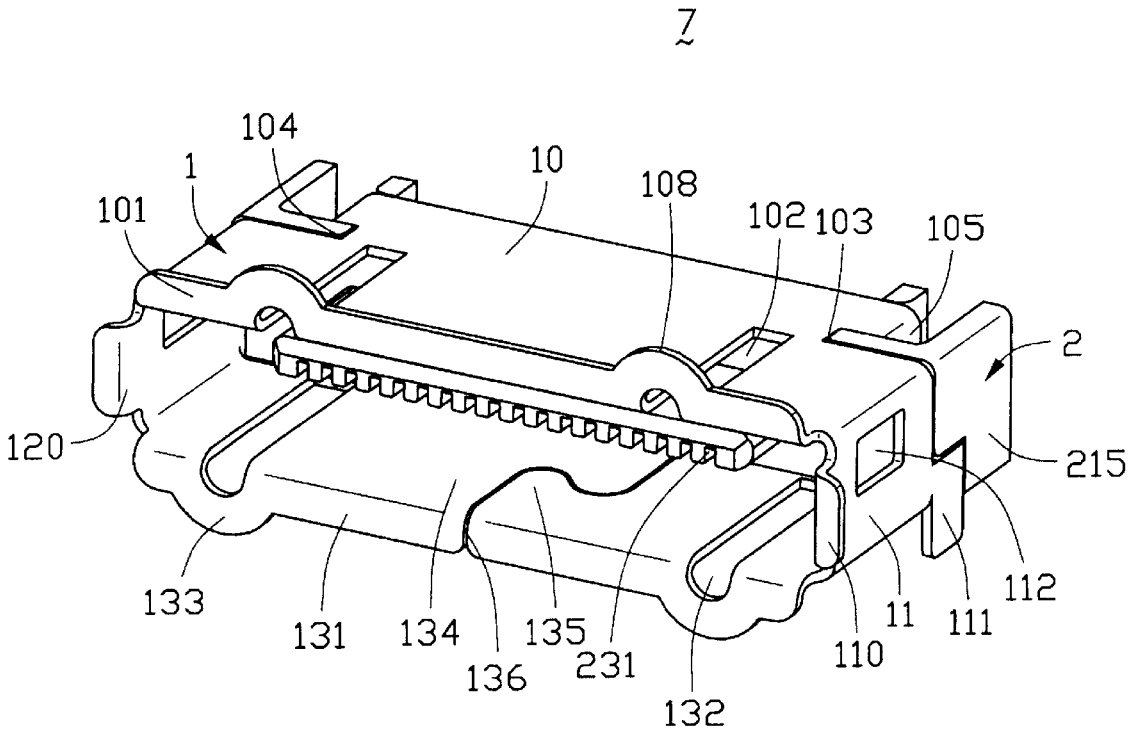
FIG. 2 is an assembled view of the electrical connector of FIG. 1.
Figure 3:
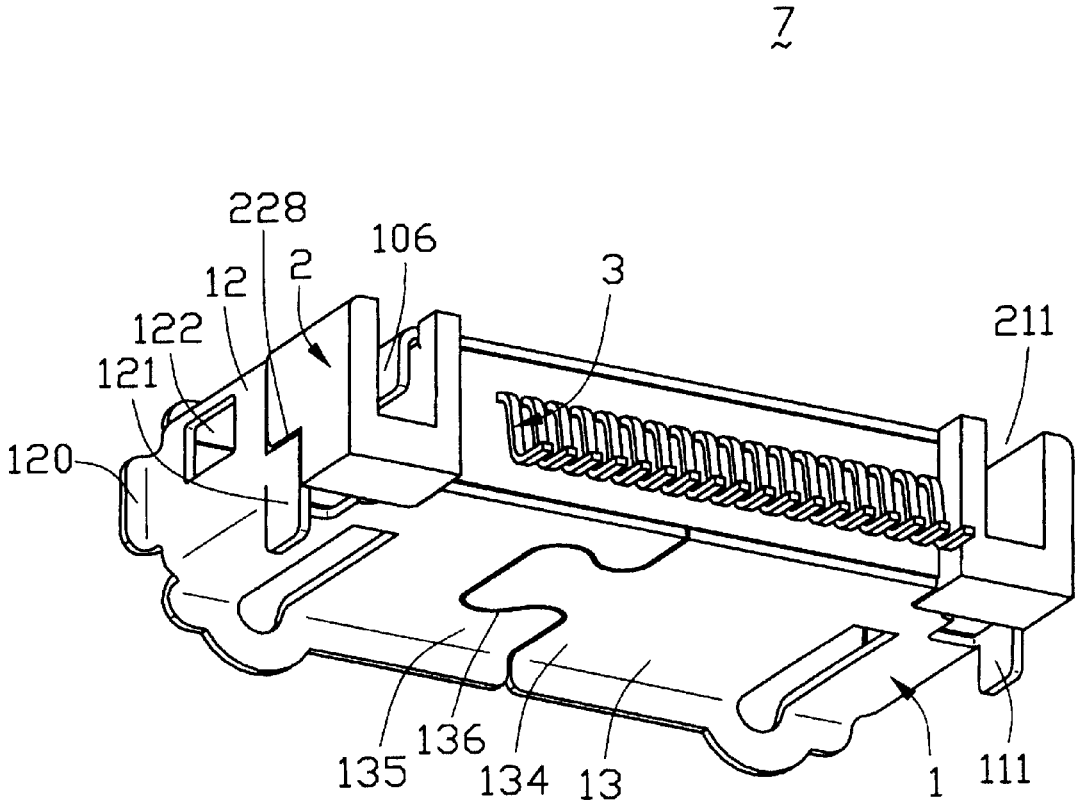
FIG. 3 is another assembled view of the electrical connector of FIG. 1, but viewed from a different angle.
Figure 4:
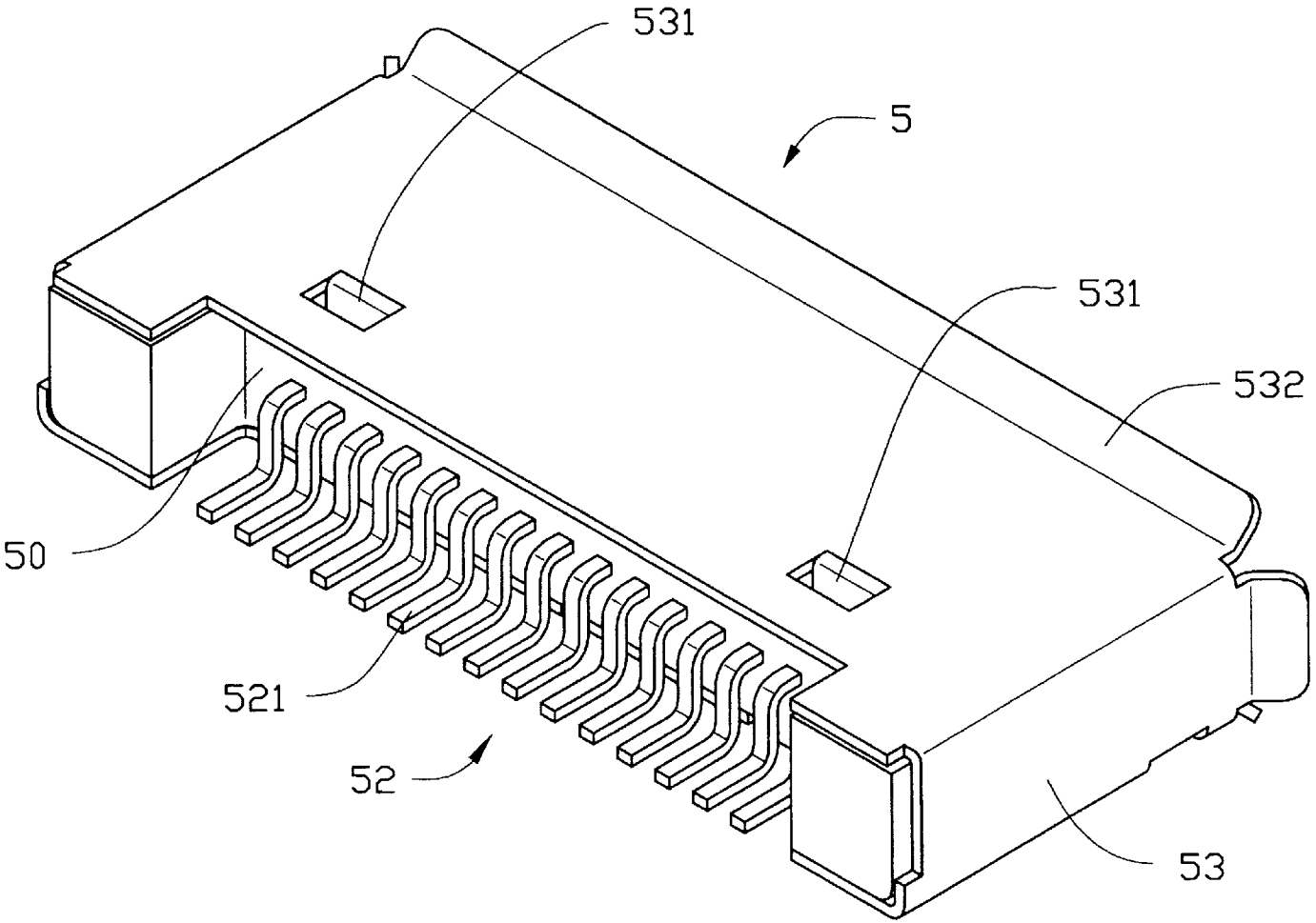
FIG. 4 (PRIOR ART)
FIG. 4 is a rear, perspective view of a conventional electrical connector.

Referring to FIGS. 1, 2 and 3, an electrical connector 7 of the present invention has a dielectric housing 2, a plurality of terminals 3 fixed to the housing 2 by insert molding, and a shield 1.

The housing 2 has an elongated body portion 20 with a mating end 23 projecting forwardly therefrom. A first side portion 21 and a second side portion 22 are formed respectively on two lateral sides of the body portion 20. The first side portion 21 has a first bottom wall 210, two first side walls 215, 216, and a first front wall 217 adjacent to the mating end 23. An upwardly and rearwardly exposed first notch 211 is defined in the first side portion 21 between the first side walls 215, 216. A first standoff 212 and a first protrusion 213 are respectively formed on the first front wall 217 and the first side wall 216. The first standoff 212 and the first protrusion 213 are at a level higher than a top surface 201 of the body portion 20. A first aperture 214 is defined between the first standoff 212 and the first protrusion 213 in communication with the first notch 211. The first side portion 21 forms a first step-like face 218 proximate to the first bottom face 210 thereof. The second side portion 22, having the same structure as the first side portion 21, has a second bottom wall 220 and a second step-like face 228, two second side walls 225, 226, a second front wall 227, a second standoff 222, a second protrusion 223 and a second aperture 224. A plurality of passageways 231 (FIG. 2) are defined in the mating end 23.

Each terminal 3 has a soldering portion 31, a connecting portion 32 and a contact portion 33. The connecting portion 32 connects the soldering portion 31 and the contact portion 33. The contact portion 33 extends slightly in an upward direction at a free end thereof.

The shield 1 is stamped from sheet metal material and is formed into a generally quadrangular tubular configuration. The shield 1 has a top wall 10, a first side wall 11 and a second side wall 12 extending perpendicularly from the top wall 10, and a bottom wall 13 composed of two opposed end portions 134, 135 bent inwardly from the first and second side walls 11, 12. A winding slit 136 is defined in the bottom wall 13 between the two opposed end portions 134, 135 when the metal material is bent into the generally quadrangular tubular configuration. An upper first flange 101 with two top semi-circular bumps 108 is formed at a front edge of the top wall 10. The top semi-circular bumps 108 are respectively formed near the first and second side walls 11, 12. A pair of first slots 102 are respectively defined in the top wall 10 and extend through corresponding top semi-circular bumps 108. A first retentive tab 105 and a second retentive tab 106 are formed at opposite rear side edges of the top wall 10. A first cutout 103 and a second cutout 104 are defined in the top wall 10 respectively adjacent to the first and second retentive tabs 105, 106. A second flange 110 is formed at a front edge of the first side wall 11. A first hole 112 is defined in an upper portion of the first side wall 11. A first locating tab 111 extends downwardly from a rear edge of the first side wall 11. A third flange 120 is formed at a front edge of the second side wall 12. A second hole 122 is defined in an upper portion of the second side wall 12. A second locating tab 121 extends downwardly from a rear edge of the second side wall 12. The bottom wall 13 has a fourth flange 131 with two bottom semi-circular bumps 133 formed thereon and align with corresponding top semi-circular bumps 108. The bottom semi-circular bumps 133 are respective formed near the first and second side walls 11, 12. Two second slots 132 are defined in the bottom wall 13 and extend through the respective bottom semi-circular bumps 133. Two openings (not labeled) are defined respectively adjacent to the first and second locating tabs 111, 121.

Referring to FIGS. 2 and 3, in assembly, the body portion 20 and the mating end 23 of the housing 2 are enclosed by the shield 1. The winding slit 136 defined by the two opposed end portions 134, 135 strengthens the integrity of the shield better than a slit in a straight line-shape. The first retentive tab 105 and the second retentive tab 106 insert respectively in the first notch 211 and the second notch 221 through the first and second apertures 214, 224. The first and second standoffs 212, 222 project respectively into the first and second cutouts 103, 104. The first and second protrusions 213, 223 abut against a rear edge of the top wall 10 of the shield 1. Thus, the first and second retentive tabs 105, 106, the first and second standoffs 212, 222 and the first and second protrusions 213, 223 prevent relative movement between the shield 1 and the housing 2 in forward, backward and sideward directions. Top edges of the first and the second locating tabs 111, 121 respectively abut against the first step-like face 218 and the second step-like face 228. As a result, relative vertical movement between the shield 1 and the housing 2 is prevented. The first slot 102 and the second slot 132 of the shield 1 receiving corresponding ribs, of a complementary plug (not shown) ensure a proper and reliable engagement between the electrical connector 7 and the complementary plug connector inserted therein. The first and second holes 112, 122 engage with latch members of the plug connector. The provision of the top semi-circular bumps 108 and the bottom semi-circular bumps 133 formed on the shield 1 ensures an easy alignment between the electrical connector 7 and an electrical or electronic appliance (not shown) when the electrical connector 7 is assembled thereto.

The plurality of terminals 3 are insert molded in the body portion 20 of the housing 2 with the contact portions 33 received in the passageways 231 of the mating end 23. The soldering portions 31 project rearward of the housing 2 with bottom sides thereof lying substantially coplanar with a bottom surface of the bottom wall 13 of the shield 1. The first and second locating tabs 111, 121 are formed to facilitate positioning of the electrical connector 7 on a printed circuit board (PCB, not shown), so that the soldering portions 31 of the terminals 3 can be correctly soldered to circuit traces on the PCB.

An advantage of the present invention over the prior art is that the pair of retentive tabs 105, 106 of the shield 1 engage with the corresponding notches 211, 221 of the housing 2, and that the top edges of the locating tabs 111, 121 abut against corresponding step-like faces 218, 228 of the housing 2. As a result, the shield 1 and the housing 2 are reliably engaged with each other. A second advantage is that the top wall 10 and the bottom wall 13 of the shield 1 respectively define the slots 102, 132 extending through the top and bottom semi-circular bumps 108, 133 for receiving the corresponding ribs of the complementary connector, and the side walls 11, 12 of the shield 1 respectively define the holes 112, 122 for receiving corresponding latches of the complementary connector, whereby a reliable engagement is formed between the electrical connector 7 and the complementary connector. A third advantage is that, due to the secure engagement between the shield 1 and the housing 2 and the provision of the locating tabs 111, 121, the soldering portions 31 of the terminals 3 are more reliably soldered to the PCB so that the terminals 3 would not separate from the PCB when the complementary connector is inserted into the electrical connector 7.

It is to be understood, however, that even though numerous, characteristics and advantages of the present invention have been set forth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing having a body portion and two side portions formed respectively on lateral sides of the body portion, each side portion having a notch defined therein, a front wall and a side wall, the front wall and the side wall respectively having a standoff and a protrusion formed thereon, the standoff and the protnion debinig an aperture therebetween;

a plurality of terminals received in the housing, each terminal having a soldering portion, a contact portion, and a connecting portion interconnecting the soldering portion with the contact portion; and a metal shield assembled to the housing, the shield having two retentive tabs and a pair of cutouts adjacent to the retentive tabs; wherein the retentive tabs engage with the notches of the housing respectively through corresponding apertures, and the standoffs of the housing project into corresponding cutouts of the shield; wherein the insulative housing has a mating end projecting forwardly from the body portion, the mating end defining a plurality of passageways for receiving the contact portions of the terminals; wherein the shield has a pair of downwardly extending locating tabs adjacent to corresponding retentive tabs; wherein each side portion of the housing has a lower, step-like face abutting against top and rear edge of a corresponding locating tab.

2. The electrical connector of claim 1, wherein the shield has a top wall, two side walls and a bottom wall opposite to the top wall, the bottom wall having two opposed end portions defining a winding slit therebetween.

3. The electrical connector of claim 2, wherein the protrusion of the housing projects upwardly from the inner wall of a corresponding side portion and abuts against a rear edge of the top wall of the shield.

4. The electrical connector of claime 2, wherein the top wall and the bottom wall of the shield respectively define two pairs of slots aligned with each other.

5. The electrical connector of claim 4, wherein each of the top wall, the bottom wall and the side walls of the shield has a flange at a front edge thereof, the flanges of the top wall and the bottom wall respectively having two pairs of vertical semi-circular bumps.

6. The electrical connector of claim 5, wherein each slot of the shield extends through a corresponding semi-circular bump of the shield.

7. An electrical connector, comprising:

a metal shield having a top wall, two side walls and a bottom wall, each of the top wall and the bottom wall having a flange with a pair of vertical semi-circular bumps at a front edge thereof, and a pair of slots extending through correspond semi-circular bumps, the top wall flirher having a pair of downwardly extending retentive tabs;

an insulative housing received in the metal shield, the insulative housing comprising a body portion having two side portions formed respectively on two lateral sides thereof, the side portions respectively defining a pair of notches for receiving the retentive tabs; and a plurality of terminals received in the housing, each terminal having a soldering portion, a contact portion, and a connecting portion interconnecting the soldering portion with the contact portion; wherein the insulative housing has a mating end projecting forwardly from the body portion, the mating end defining a plurality of passageways for receiving the contact portions of the terminals; wherein each side portion of the housing has a front wall, two side walls and a bottom wall, the front wall and one of the side walls respectively having a standoff and a protrusion formed thereon, the standoff and the protrusion defining an aperture therebetween communicating with the notch of a corresponding side portion.

8. The electrical connector of claim 7, wherein the bottom wall of the shield has two opposed end portions defining a winding slit therebetween.

9. The electrical connector of claim 7, wherein the top wall of the shield defines a pair of cutouts for receiving the respective standoffs of the housing, and the protrusions of the housing abut against a rear edge of the top wall of the shield.

10. The electrical connector of claim 7, wherein the side walls of the shield have a pair of respective locating tabs at rear edges thereof, and each side portion of the housing has a lower, step-like face abutting against top and rear edges of a corresponding locating tab.

11. The electrical connector of claim 7, wherein each side wall of the shield defines a hole for engaging with a corresponding latch member of a mating connector.

* * * * *